US006335093B1

(12) United States Patent
Mori et al.

(10) Patent No.: US 6,335,093 B1
(45) Date of Patent: Jan. 1, 2002

(54) COMPOSITE CRIMPED YARN

(75) Inventors: Toshiaki Mori; Hiroshi Yamazaki, both of Ibaraki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/600,838

(22) PCT Filed: Jan. 25, 1999

(86) PCT No.: PCT/JP99/00260

§ 371 Date: Jul. 24, 2000

§ 102(e) Date: Jul. 24, 2000

(87) PCT Pub. No.: WO99/37837

PCT Pub. Date: Jul. 29, 1999

(30) Foreign Application Priority Data

Jan. 27, 1998 (JP) ..... 10-014209
Aug. 20, 1998 (JP) ..... 10-249057

(51) Int. Cl.[7] ..... D01F 8/00

(52) U.S. Cl. ..... 428/370; 428/393; 428/395; 57/239; 57/238; 57/244; 57/247

(58) Field of Search ..... 478/370, 393, 478/395; 57/239, 238, 244, 247

(56) References Cited

U.S. PATENT DOCUMENTS 4,180,968 A * 1/1980 White ..... 57/239
6,074,751 A * 6/2000 Murakami ..... 428/373

FOREIGN PATENT DOCUMENTS

| | | |
|---|---|---|
| JP | 62-299527 | 12/1987 |
| JP | 05163645 | 6/1993 |
| JP | 06330424 | 11/1994 |
| JP | 07003633 | 1/1995 |
| JP | 08170238 | 7/1996 |
| JP | 09003740 | 1/1997 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

Composite crimped yarn comprising 50–90 wt. % of cellulose filaments and synthetic fiber filaments and having a crimp elongation percentage of 0.1–4.0%; and a weft knitted fabric comprising the composite crimped yarns. A weft knitted fabric comprising the composite crimped yarns does not substantially have weft bar has a high-quality appearance, a glossiness and hand touchness of the cellulose filaments, and excellent shrinkage proofing properties and setting properties, so that this weft knitted fabric can be applied to clothing goods, such as inner wear, sports wear and outer wear which are required to have excellent, a wet strength, dimensional stability and a high quality of knitted fabric.

6 Claims, 1 Drawing Sheet

COMPOSITE CRIMPED YARN

TECHNICAL FIELD

The present invention relates to a composite textured yarn comprising cellulose filaments and synthetic fiber filaments of a polyester etc. The present invention relates, in more detail, to a composite crimped yarn which gives a weft knitted fabric having no weft bar, a high-quality appearance, and glossiness and a feeling of cellulose filaments and excellent in shrinkage proofing properties and setting properties, and a weft knitted fabric in which the composite crimped yarn is used.

BACKGROUND ART

Since cellulose filaments are excellent in glossiness, feeling, moisture absorption and drapability, and have a good touch, they show excellent properties as materials for apparel such as innerwear and outerwear. However, the cellulose filaments have drawbacks related to the physical properties and their use as explained below. A knitted fabric prepared therefrom tends to form weft bar, and does not have a high-quality appearance. It has poor dimensional stability and strength when it is wetted, and it tends to form creases. In order to remove such drawbacks, a composite textured yarn in which synthetic fiber filaments of polyester etc. are used in combination has heretofore been proposed.

For example, Japanese Unexamined Patent Publication (Kokai) No. 62-299527 proposes a composite combined yarn which is obtained by uniformly combining, by fluid interlacing, a polyester fiber spun at a winding speed of at least 7,000 m/min and having a low boil-off shrinkage and a regenerated cellulose fiber, which suppresses hardening of the feeling caused by shrinkage of the polyester filaments subsequent to dyeing, and which has the hand touchness of cellulose. However, the yarn tends to form weft bar because the polyester is not subjected to fine crimping in contrast to that in the present invention. Moreover, the yarn tends to have a moire tone during dyeing because it shows poor uniform combining properties when compared with a yarn which is false-twisted. That is, the yarn is poor in a dyeing quality.

Furthermore, Japanese Unexamined Patent Publication (Kokai) No. 8-170238 proposes a composite false-twisted yarn prepared by doubling, or combining and false-twisting regenerated cellulose filaments and a self-crimping type of polyester filaments, namely, polyester filaments composed of a composite fiber that is formed by bonding two components differing from each other in shrinkage. However, the yarn is heated only when false twisted, and it is not heated in a setting zone after untwisting, whereby the degree of crimping is increased. As a result, a circular knitted fabric prepared therefrom has the following disadvantages. The polyester fiber tends to be projected out the surface, and the fabric hardly has the glossiness and hand touchness of cellulose filaments, and has a low quality because it has a waxy hand touchness specific to polyester and a bulky and elastic hand touchness specific to a synthetic fiber.

Japanese Unexamined Patent Publication (Kokai) No. 6-330424 proposes a process for producing a fabric excellent in hand touchness, which comprises fluid interlacing a cellulose-based fiber as a sheath yarn and a composite fiber as a core yarn that is formed from (a) a polyester obtained by copolymerizing in a specific proportion a component having a side chain type of specific polyalkylene groups, isophthalic acid, a polyalkylene glycol component, etc., and (b) at least another fiber-forming polymer, and alkali treating the resultant combined yarn or a fabric formed from the combined yarn, thereby dissolving and removing at least part of the copolymerized polyester. However, in the process, cellulose filaments are overfed so that the proportion of the cellulose fiber increases in the sheath yarn of the combined yarn, and loop-like or curl-like protrusions of the cellulose filaments are formed by a fluid pressure of 4 to 10 kg/cm$^2$. Consequently, a knitted fabric prepared from the combined yarn has the following disadvantages: the fabric has little of the glossiness of cellulose filaments and has a low quality appearance; and moreover, weft bar are likely to be formed because the polyester fiber in the core portion is not crimped.

Japanese Unexamined Patent Publication (Kokai) No. 9-3740 discloses a composite textured yarn obtained by combining and false-twisting synthetic fiber filaments that show a boil-off shrinkage of 8 to 60% and cellulose filaments. However, since the yarn is not heat set at temperatures of 100 to 250° C. after untwisting following the false-twisting step, the synthetic fiber filaments manifest crimping when treated with hot water during dyeing or the like, and the cellulose filaments are considerably opened because the hot water shrinkage of the synthetic fiber is large. As a result, the cellulose filaments project out the surface of the composite textured yarn, and the loops of the yarn become disordered when the yarn is formed into a knitted fabric, thereby showing a low quality appearance and giving a poor hand touchness.

Japanese Unexamined Patent Publication (Kokai) No. 5-163645 discloses a technology of suppressing the formation of weft bar by the use of a composite yarn obtained by doubling and twisting a false-twisted yarn of viscose rayon and a polyester yarn. However, since the composite yarn is twisted, it cannot have the glossiness and hand touchness of cellulose filaments. The composite yarn has a waxy hand touchness specific to a polyester fiber because a polyester fiber is doubled and twisted. Moreover, although formation of weft bar is suppressed, the suppression is insufficient because the polyester yarn is not crimped.

As explained above, even when a decrease in the dynamic strength and the shrinkage, of a cellulose fiber in a wet state, of yarns obtained by conventional technologies can be suppressed, the yarns have a waxy feeling of a polyester fiber, and a bulky and elastic feeling specific to a synthetic fiber. None of the yarns have given a weft knitted fabric of high quality having no weft bar and glossiness and a hand touchness very close to that of a yarn containing 100% of cellulose filaments.

An object of the present invention is to provide a composite crimped yarn which gives a weft knitted fabric having no weft bar, an appearance of high quality, and glossiness and a hand touchness of cellulose filaments, and being excellent in shrinkage proofing properties and setting properties, and a weft knitted fabric in which the yarn is used.

DISCLOSURE OF THE INVENTION

As a result of intensively carrying out investigations in view of the drawbacks as explained above, the present inventors have achieved the present invention.

That is, the present invention provides a composite crimped yarn which comprises from 50 to 90% by weight of cellulose filaments and synthetic fiber filaments, which shows a crimping elongation of 0.1 to 4.0%, and which is combined and false-twisted, and a weft knitted fabric which is formed from the composite crimped yarn, and the cellulose filaments of which show a surface occupation rate of at least 70% on the knitted fabric and more than weight proportion.

BEST MODE FOR CARRYING OUT THE INVENTION

The present inventors have found that weft bar in a weft knitted fabric containing cellulose filaments are formed due to a dynamic strain of the yarn produced by a knitting needle during knitting, friction between loops and a structural strain (produced by variation in the shape and size of loops between the adjacent courses caused by the control limit and wear of the cams of the knitting machine). The present inventors have therefore intensively carried out investigations. As a result, we have made discoveries as explained below to achieve the present invention. When fine crimps of the cellulose filaments are formed in combination with the synthetic fiber, formation of weft bar during knitting is suppressed because the strain of the yarn and the friction among loops are decreased. In the scouring, heat setting and dye finishing steps, the structural strain is relaxed; the crimps of the cellulose filaments are removed due to the water-caused swelling and drying of the cellulose filaments, and the crimps of the polyester filaments are removed due to, for example, heat setting which will be explained later. As a result, the glossiness and feeling of cellulose filaments are obtained because the cellulose filaments form the sheath portions of the yarn due to a difference in shrinkage between the two types of the filaments.

Figure 1:
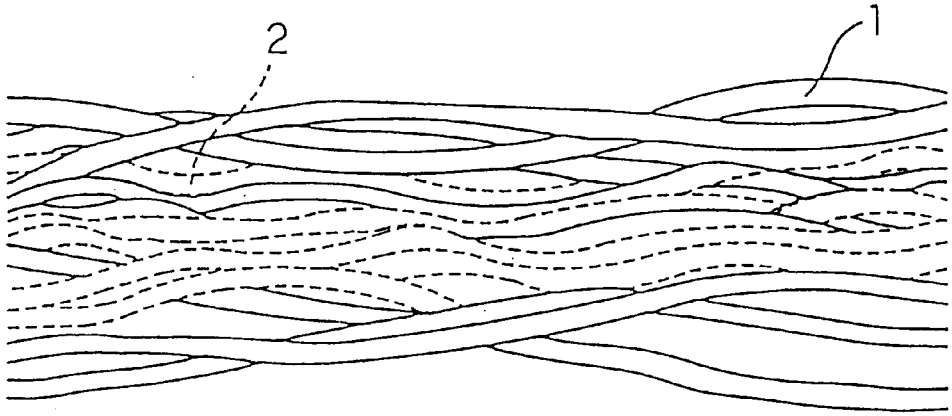
FIG. 1 is a side view showing one example of the composite crimped yarn of the present invention.

The composite crimped yarn of the present invention is an approximately uniformly combined yarn comprising cellulose filaments having fine crimps and synthetic fiber filaments having fine crimps. The composite crimped yarn of the present invention comes to have a sheath core structure showed in FIG. 1 in which a synthetic fiber filament 2 forms a core and a cellulose filament 1 forms a sheath by subjecting the composite crimped yarn to post-treatment that will be explained in detail later. The sheath core structure is considered to be formed because the synthetic fiber filaments do not substantially manifest new crimps and show shrinkage to such a degree that the cellulose filaments are not disordered. In this case, the cellulose filaments mainly occupy the sheath portions without significant arrangement disorder.

Figure 2:
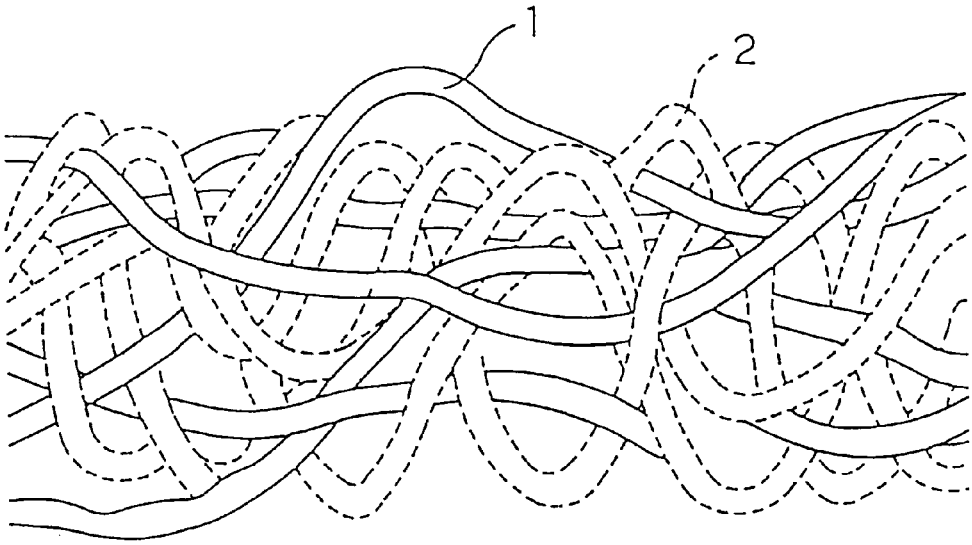
FIG. 2 is a side view of a composite textured yarn that is one comparative example.

In a composite crimped yarn false-twisted under ordinary false-twisting conditions, namely, at temperature lower than the melting starting temperature of the synthetic fiber filaments by 20 to 30° C., the arrangement of the cellulose filaments 1 is greatly disordered by the significant crimping of the synthetic fiber filaments 2, and the synthetic fiber filaments are projected out the surface of the composite textured yarn showed in FIG. 2.

The weft bar in the present invention differ from a patterning by the knitted structure of a weft knitted fabric, but designate a streak-like or stripe-like unevenness of color and yarn which appears along a specific supplied yarn.

The composite crimped yarn according to the present invention comprises cellulose filaments and synthetic fiber filaments, and the cellulose filaments are approximately uniformly combined in a proportion of 50 to 90% by weight, preferably 60 to 80% by weight. When the proportion of the cellulose filaments is less than 50% by weight, the glossiness and feeling that the cellulose filaments have cannot be obtained. Moreover when the proportion of the cellulose filaments exceeds 90% by weight, the tenacity of the yarn in a wet state is low, and the yarn shows a poor dimensional stability; weft bar tends to be formed. That filaments are approximately uniformly combined signifies that the filaments are approximately uniformly combined over the entire cross-section of the yarn, and a local nonuniformity to some extent does not matter. Furthermore, heat applied during false-twisting makes the proportion of the cellulose filaments occupying the surface of the composite crimped yarn likely to become high. Such a phenomenon is preferable from the standpoint of obtaining the glossiness and feeling of cellulose filaments that is an object of the present invention, and there arises no problem even when such a phenomenon is produced.

Furthermore, "fine crimps" in the present invention designates a state of filaments forming fine waves. The degree of fine crimps is defined by a crimping elongation. The crimping elongation must be from 0.1 to 4.0%, preferably from 0.2 to 3.0%, more preferably from 0.3 to 2.0%.

Still furthermore, when the crimping elongation is less than 0.1%, formation of weft bar cannot be suppressed. When the crimping elongation exceeds 4.0%, crimps remain after dyeing. As a result, the proportion of the synthetic fiber filaments appearing on the surface of the composite textured yarn becomes high, and the glossiness and hand touchness of the cellulose filaments are impaired. When the crimping elongation is from 0.1 to 4.0%, a weft knitted fabric prepared from the yarn has an appearance of high quality with weft bar suppressed, and it has the glossiness and hand touchness of cellulose filaments, and excellent shrinkage proofing properties and setting properties.

Moreover, the crimping elongation of the yarn after boil-off treatment is preferably from 0.1 to 5.0% because the yarn tends to have the glossiness and hand touchness of cellulose filaments, more preferably from 1.2 to 4.0%.

The dry heat shrinkage of the composite crimped yarn of the present invention subsequent to boil-off treatment is preferably from 1.0 to 5.0%. A knitted fabric prepared from the yarn satisfying the conditions is likely to have a sheath core structure wherein the cellulose filaments form sheaths and the synthetic fiber filaments form cores, when the fabric is heat set. When the yarn subsequent to boil-off treatment shows a dry heat shrinkage less than 1.0%, formation of the sheath core structure is insufficient. When the yarn shows a dry heat shrinkage exceeding 5.0%, the cellulose filaments are disordered, and the glossiness and hand touchness specific to cellulose filaments are hardly obtained. Accordingly, the dry heat shrinkage ranges mentioned above are not preferred.

Examples of the cellulose filaments in the present invention include cellulose such as cuprammonium rayon (cupro), viscose rayon and polynosic rayon. The size of the filaments for a circular knitted fabric is preferably from 0.5 to 5.0 denier, more preferably from 1.0 to 2.0 denier. The number of filaments of the cellulose filaments is preferably from 10 to 100, more preferably from 30 to 90. When the number of the filaments is as mentioned above, combining the cellulose filaments with synthetic fiber filaments becomes easy, and the soft hand touchness of cellulose filaments is preferably utilized. Moreover, when a flat knitted fabric is required to have a harsh hand touchness, a hard and repulsive hand touchness, filaments having a size of about 5 to 100 denier can be used.

There is no specific limitation on the process of spinning the cellulose filaments used in the present invention; any of the spinning processes such as the Hank process, the cake process, the spool process, the net process and the continuous process can be used. Moreover, at least two types of such filaments may also be used in combination. Of these filaments, cellulose filaments prepared by spinning by the net process are preferred because the cellulose filaments can be easily interlaced with synthetic fiber filaments more uniformly by fluid interlacing and weft bar are hardly formed in the weft knitted fabric obtained from the interlaced yarn. Furthermore, the cellulose filaments used in the present invention may optionally contain delustering agents such as titanium oxide and various known additives.

Examples of the synthetic fiber filaments used in the present invention include filaments formed from a thermoplastic polymer of, for example, a polyester such as polyethylene terephthalate, polytrimethylene terephthalate and polybutylene terephthalate, a polyamide such as nylon 6 and nylon 66 and the like. Moreover, the synthetic fiber filaments may optionally contain various known additives.

Polyester fibers are preferably used as the synthetic fiber filaments in the present invention. The polyester fibers include those of a regular type, those of a normal pressure-dyeable type, those of a thick and a thin type and those of ultra-high speed spinning type. In particular, use of a polyester fiber of normal pressure-dyeable type which has a melting-starting temperature from 200 to 240° C. enables alkali reduction even in an aqueous alkaline solution the alkalinity of which is of such a degree that cellulose filaments do not show tenacity deterioration; as a result the hand touchness of cellulose filaments is likely to be obtained. Moreover, when a polyester fiber is used, a flat knitted fabric obtained from the resultant yarn becomes excellent in Hoffmann setting, sewability and dimensional stability, and in particular, even a knitted fabric such as plain knitting, which tends to form curls, shows good steam setting properties. Accordingly, use of a polyester fiber is preferred.

One example of the polyester filaments of normal pressure-dyeable type is the filaments composed of polyester copolymer prepared by copolymerisation of a mixture of terephthalic acid or its derivative, and ethylene glycol, propylene glycol, butylene glycol or the derivative, adding one or at least two third components, in the presence of a catalyst.

Examples of the third component to be added include aliphatic dicarboxylic acids such as oxalic acid and adipic acid, alicyclic dicarboxylic acids such as cyclohexanedicarboxylic acid, aromatic dicarboxylic acids such as isophthalic acid and sodium sulfoisophthalate, aliphatic glycols such as ethylene glycol, 1,2-propylene glycol, trimethylene glycol and tetramethylene glycol, alicyclic glycols such as cyclohexanediol, aromatic dioxy compounds such as hydroquinone bisphenol A, such aliphatic glycols each containing an aromatic group as 1,4-bis(β-hydroxyethoxy)benzene, polyether glycols such as polyethylene glycol and polypropylene glycol, aliphatic oxycarboxylic acids such as ω-oxycaproic acid, and aromatic oxycarboxylic acids such as p-oxybenzoic acid.

Furthermore, such a compound having one or at least three ester-forming functional groups as benzoic acid or glycerin can be used so long as the polymer is substantially linear.

The third components are preferably selected and their amounts are preferably determined in such a manner that the melting-starting temperature of the copolymerized polyester falls in the range of 200 to 240° C.

The melting-starting temperature of a copolymerized polyester herein is obtained, in the following manner, from a melting curve which is prepared by plotting a heat flow value (endothermic) against a temperature with the heat flow value measured while the polyester is being heated under at a rate of 5° C./min in a nitrogen gas flow using a differential scanning calorimeter (for example, DSC2920 Modulated DSC (trade name, manufactured by TA Instrument)). That is, the cross point of the following two lines is defined as the melting-starting temperature: a straight line L connecting a point where the melting curve starts bending on the endothermic side from the reference line and a point where the melting curve returns to the reference line after the end of melting; and a tangential line L at the maximum inclined point of the melting curve heading toward the melting peak.

When the melting-starting temperature is in the range mentioned above, the false-twisting temperature and the dyeing temperature can be lowered, and as a result the cellulose is less deteriorated. Moreover, steam setting is well effected during weft knitting. Accordingly, the melting-starting temperature range is preferred.

Examples of the polyester fiber include a polyester fiber of normal pressure-dispersed dyeable type in which polyoxyethylene glycol is copolymerized as a third component, a polyester fiber of normal pressure-dispersed dyeable type in which polyethylene glycol and adipic acid are copolymerized, and a polyester fiber of normal pressure cation dyeable type in which sodium sulfoisophthalate and adipic acid are copolymerized.

There is no specific limitation on the spinning method of the synthetic fiber filaments used in the present invention. They may be produced by any of the spinning methods such as a method wherein an unstretched yarn is wound at a winding speed of about 1,500 m/min, and the wound yarn is drawn and twisted by a factor of about 2 to 3.5, a direct drawing method in which a spinning step and a drawing and twisting step are directly connected and a high speed spinning method in which a yarn is wound at a speed of at least 5,000 m/min.

Furthermore, there is no specific limitation on the cross-sectional shape of each of the filaments. The cross section of the filament may have a polygonal shape such as a circular shape, a triangular shape, an L shape, a T shape, a Y shape, a W shape, an eight-leaf shape, a flat shape or a dog bone shape, a multi-leaf shape, a hollow shape and an indefinite shape. The size of the filaments is preferably from 0.1 to 5.0 denier, more preferably from 0.1 to 2.2 denier because the fabric becomes soft.

Although a process of producing the composite crimped yarn of the present invention will be explained below, there is no specific limitation on the production process.

Combining cellulose filaments and synthetic fiber filaments is preferably carried out by a so-called interlacing which is an air combination interlacing. The number of interlacings during combination interlacing is preferably from 20 to 120 per meter of the yarn because the yarn is uniformly combined. Fine crimps are usually imparted by false twisting. In order to combine more uniformly and form the sheath core structure of the present invention, false twisting is preferably conducted after combining.

There is no specific limitation on the method of false twisting so long as the method uses an apparatus capable of heating (heat setting subsequently to untwisting) in the false twisting zone and setting zone after untwisting. A commonly used apparatus such as a pin type, a friction type, a belt nip type or an air twisting type of apparatus is used. In addition, an apparatus capable of consecutively conducting combining and false twisting is preferred because it shows good productivity. The conditions for making the yarn show a crimping elongation of 0.1 to 4.0% by false twisting are explained below, although the conditions depend on the melting point of the synthetic fiber. The false-twisting temperature (H1) of, for example, a polyester fiber is usually from 100 to 190° C., more preferably from 120 to 180° C. The heat setting temperature (H2) subsequent to untwisting is preferably from 140 to 220° C., more preferably from 150 to 200° C. The false twisting in the present invention is carried out at far lower temperature than that of the conventional false twisting. When the false-twisting temperature (H1) is lower than 100° C., sufficient crimping is hardly obtained. When H1 exceeds 190° C., the crimping becomes large, and the yarn comes to have a waxy hand touchness and a bulky and elastic hand touchness specific to a synthetic fiber. The yarn therefore cannot have the hand touchness of cellulose filaments of the present invention. In order to impart minimum crimping to the yarn necessary for suppressing the formation of weft bar during knitting, heat setting subsequent to untwisting is conducted at temperatures higher than H1 or at 140° C. or more. Consequently, potential crimping of the polyester filaments is minimized, and the degree of crimping the polyester filaments in the steps of scouring, heat setting and dyeing can be reduced. As a result, a weft knitted fabric formed from the composite crimped yarn can have the glossiness and hand touchness of cellulose filaments, and show good moisture absorption and drapability. Moreover, when the heat setting temperature (H2) subsequent to untwisting is lower than 140° C., the potential crimping of the polyester filaments is markedly manifested during dyeing. Furthermore, when the yarn is treated at temperatures exceeding 220° C., even the thermal shrinkage of the polyester filaments is lost, and as a result the yarn hardly has the sheath core structure of the present invention. Still furthermore, fine crimping tends to be lost, and there is the possibility that weft bar is formed during knitting.

Furthermore, the feed rate is preferably set at 5% or less in the setting zone after untwisting because fine crimping is likely to be imparted.

Still further, for a nylon 66 fiber, the false-twisting temperature (H1) and the heat setting temperature (H2) subsequent to untwisting are comparable to those of a polyester fiber. However, the nylon 6 fiber having a low melting point is preferably false-twisted while both H1 and H2 (false-twisting conditions) are lowered by 10 to 20° C. compared with those of polyester filaments.

The false-twisting temperature (H1) and the heat setting temperature (H2) subsequent to untwisting in the present invention are expressed by the respective heater temperatures in the false-twisting machine.

There is no specific limitation on the method of dyeing the composite crimped yarn of the present invention and its weft knitted fabric, and any method may be conducted. For example, when a textured yarn prior to knitting is to be dyed, yarn dyeing wherein a yarn in a hank or a cheese-like state is dyed may be conducted; when a yarn in a knitted state is to be dyed, piece dyeing may be conducted. Dyes, dyeing assistants and finishing agents can be freely selected from those which are commercially available and which are used for dyeing synthetic fibers and cellulose fibers. When the composite crimped yarn of the present invention or its weft knitted fabric is to be dyed, such pretreatments conventionally practiced before dyeing as scouring, bleaching, alkaline treatment for improving the dyeability of cellulose-based fibers and alkaline reduction for polyester-based fibers can be conducted.

Furthermore, the fabric prior to or/and subsequent to dyeing is preferably heat treated at temperatures of 180 to 200° C. because the sheath core structure of the present invention tends to be manifested. Conducting the heat treatment while the fabric is in an open-width state is more preferred. That the fabric is in an open-width state designates that the fabric is in a state of being spread. The tension applied to the fabric when the fabric is in an open-width state is preferably low to such a degree that the creases of the fabric subsequent to heat treatment are smoothed out. For example, a tension is preferably applied to the fabric to such a degree that the fabric is finished to have an increase in width of the fabric of −10 to +10% and an increase in length thereof of −10 to 10% based on the width and the length, respectively, of the non-treated fabric.

The weft knitted fabric in which the composite crimped yarn of the present invention is used may be either a flat knitted fabric or a circular knitted one. Plain knitting, an interlock fabric, a tuck float fabric, rib knit, purl stitch, Ponte di Roma, Milano Rib or a changed structure of any of these fabrics can be used as a structure of the knitted fabric. A fabric may be suitably selected from such ones in accordance with the object of the products. A preferred gauge is, for example, from 14 to 40 GG for circular knitting, and from 3 to 22 GG for flat knitting.

In addition, warp knitting such as Half tricot stitch and raschel can be formed as the knitting structure of the present invention, and orderly warp knitting without warp streaks can be carried out. The gauge in warp knitting is preferably from 14 to 40 GG.

The surface occupation rate of cellulose filaments on the surface of a weft knitted fabric in which the composite crimped yarn of the present invention is used is preferably at least 70%, more preferably at least 80%, still more preferably at least 90%.

When the surface occupation rate of the cellulose filaments is less than 70%, the glossiness and hand touchness of cellulose filaments are hardly obtained.

The KES Linearity of compression-thickness curve (LC) of the knitted fabric of the present invention is preferably from 0.30 to 0.55 because coolness and an excellent hand touchness and drapability can be obtained in addition to the glossiness and hand touchness of cellulose filaments. When LC exceeds 0.55, the knitted fabric tends to have a bulky and elastic hand touchness specific to a synthetic fiber. When LC is less than 0.30, weft bar tends to be formed. Accordingly, the ranges of LC mentioned above are unpreferable.

The composite crimped yarn of the present invention can be applied to a woven fabric. The yarn is twisted, and a crepe de chine-like or crepe georgette-like woven fabric can be prepared therefrom; or the yarn is not twisted, and a woven fabric can be prepared therefrom. A woven fabric in which the composite crimped yarn of the present invention is used is excellent in shrinkage proofing properties, and has the glossiness and hand touchness of cellulose filaments.

When cellulose filaments such as cuprammonium rayon filaments that tend to be fibrillated are used, sanding with alkaline treatment etc., or biological processing with cellulase of the fabric makes the fabric fibrillated (powder touch finished) and have an appearance and a hand touchness of high quality similarly to a knitted or woven fabric in which cuprammonium rayon is used in a proportion of 100% and excellent shrinkage proofing properties.

In particular, a circular knitted fabric prepared from the composite crimped fabric of the present invention has an appearance of high quality with a powder touch finish as explained above. Moreover, the fabric has no weft bar, whereas a knitted fabric having no weft bar cannot be prepared when cuprammonium rayon is used in a proportion of 100%.

Known technologies such as conventional resin treatment, functional treatment and hand touchness-forming treatment by physical rubbing using a tumbler etc., can be applied to the composite crimped yarn of the present invention and a weft knitted fabric prepared therefrom so long as the object of the present invention is not impaired.

The present invention will be specifically explained below by making reference to examples. However, the present invention is in no way restricted thereto.

In addition, evaluation and analysis of the physical properties, hand touchness, etc., of samples are carried out by the following procedures.

(1) Moisture Conditioning of Samples

Samples to be used for measuring physical properties and hand touchness are left, in advance, in an atmosphere at 20° C. with relative humidity of 65% (standard state) for at least 48 hours to be moisture conditioned.

(2) Crimping Elongation (%)

The crimping elongation prior to boil-off treatment is measured by the following procedure. The measurement is made ten times, and the results are expressed by the average value.

A load corresponding to 2 (mg/d)×D (d) (wherein D is a total size of the composite crimped yarn, and d designates denier, and so forth on) is applied to the test sample by suspension as an initial load for 30 sec, and then two points 20 cm apart are marked on the sample. The length is defined to be L0. A load of 100 (mg/d)×D (d) is subsequently applied for 30 sec, and the length between the marks is read. The length is defined to be L. Using L0 and L, the following formula is calculated to give measurement results:

$$[(L-L0)/L0]\times 100$$

(3) Crimping Elongation Subsequent to Boil-Off Treatment

The crimping elongation subsequent to boil-off treatment is measured by the following procedure. The measurement is made ten times, and the results are expressed by the average value.

A sample is immersed in boiling water for 30 minutes, and taken out. Water absorbed thereto is lightly removed with a blotting paper sheet, and the sample is air-dried. The sample is then left in a thermo-hygrostat in a standard state for 24 hours to give a test yarn.

A load corresponding to 2 (mg/d)×D (d) is applied to the test yarn by suspending, as an initial load for 30 sec, and then two points 20 cm apart are marked on the yarn. The length is defined to be L0. A load of 100 (mg/d)×D (d) is subsequently applied for 30 sec, and the length between the marks is read. The length is defined to be L. Using L0 and L, the following formula is calculated to give measurement results:

$$[(L-L0)/L0]\times 100$$

(4) Dry Heat Shrinkage (%) Subsequent to Boil-Off Treatment

To a composite textured yarn is applied 100 (mg/d)×D as an initial load, and two points 500 mm apart are marked on the yarn. The initial load is removed, and the yarn is immersed in boiling water for 30 minutes. The yarn is then taken out, and water absorbed thereto is lightly removed with a blotting paper sheet. The yarn is then air dried, and left in a thermo-hygrostat in a standard state for 24 hours. The initial load is applied again, and the distance LB (mm) between the two points is measured. The hot water shrinkage BS (%) is calculated from the formula:

$$BS(\%)=(500LB)/500\times 100$$

The initial load is then removed, and the yarn is suspended in a drying machine at 180° C. for 30 minutes. The yarn is subsequently taken out, cooled to room temperature, and left in a thermo-hygrostat in a standard state for 24 hours. The initial load is then applied to the yarn, and the length LD (mm) between the two points is measured. The dry heat shrinkage DS (%) is calculated from the formula:

$$DS(\%)=(LB-LD)/LB\times 100$$

(5) Surface Occupation Rate (%) of Cellulose Filaments on a Knitted Fabric

Cellulose filaments are one thread dyed with a blue direct dye mentioned below, or synthetic fiber filaments are also multicolor dyed with a red dispersion dye mentioned below. The image of the knitted fabric thus obtained in an area of 30×30 mm is taken in a personal computer (trade name of 4100/MXV, manufactured by DELL) as one with a resolution of 600 dots/inch by a scanner (trade name of JA-330P, manufactured by Sharp Corporation). The data are converted into two digits with image analysis software (trade name of IP-1000PC, manufactured by Asahi Chemical Industry Co., Ltd.), and the surface occupation rate is obtained by analyzing the area ratio.

Since each of the samples in examples and comparative examples of the present invention is subjected to multicolor dyeing by the following dye prescriptions, the image taken in with full colors is color separated into yellow, magenta and cyan; the cyan is taken out, and the concentration is classified into 256 gradations. The data are converted into two digits with the threshold value defined as 198, and the area ratio of the cellulose filaments is calculated.

Dye Prescriptions for Measuring the Surface Occupation Rate of a Knitted Fabric

- For Composite Crimped Yarn Formed with Polyester Filaments
  - Blue direct dyestuff for cellulose filaments:
    - Sirius Supra Blue G (manufactured by Dye Star)
    - Concentration of dyestuff 1% owf
  - Red disperse dyestuff for polyester filaments:
    - Dianix Red BN-SE (manufactured by Dye Star)
    - Concentration of dyestuff 1% owf
  - Assistant: 1 g/l of Disper TL; and 5 g/l of sodium sulfate
  - Boiling for 30 minutes
- For Composite Crimped Yarn Formed with Nylon 66 Filaments
  - Blue direct dyestuff for cellulose filaments:
    - Sirius Supra Blue G (manufactured by Dye Star)
    - Concentration of dyestuff 1% owf
  - Red disperse dyestuff for nylon 66 filaments:
    - Telon Red BN02 (manufactured by Dye Star)
    - Concentration of dyestuff 1% owf
  - Assistant: 5 g/l of sodium sulfate
  - Boiling for 30 minutes The owf herein signifies a weight proportion of a dyestuff to a knitted fabric (fiber).

(6) Thickness of a Knitted Fabric

The thickness of a weft knitted fabric is measured by a thickness testing method specified by JIS L-1096.

(7) Compression Property of a Knitted Fabric

The compression property of a knitted fabric is calculated from a curve which is obtained by measuring, in accordance with a method of testing a linearity of compression-thickness curve (LC) in the testing method of Kawabata Evaluation System (KES), a change in the thickness of a weft knitted fabric when the pressure applied to the end face of a thickness measurement terminal is continuously changed from 0.5 to 50 g/cm$^2$.

(8) Weight of a Knitted Fabric

The weight of a weft knitted fabric is measured by the testing method specified by JIS L-1096.

(9) Shrinkage by Washing

The shrinkage of a sample is measured in accordance with JIS L-1042 (method (G method) of measuring shrinkage with a household electric washer (tumbler drying)).

(10) Wash-and-Wear Properties (W & W Properties)

The state of creases in a sample subsequent to a washing test is rated by employing as criteria three-dimensional replicas at 6 stages specified by AATCC Test Method 124-1984.

(11) Judgment of Weft Bar of a Knitted Fabric

A sensory test with a visual sense is conducted by each of 10 inspectors doing research on fibers, and a streak-like or stripe-like unevenness of color and yarn that appears along a specific supplied yarn is rated in accordance with the following 5 grades. The results are expressed by a numerical value obtained by averaging the test results of the 10 inspectors.

Fifth grade: Weft bar cannot be recognized.

Fourth grade: Weft bar is faintly observed when the observation angle is selected.

Third grade: Weft bar is faintly observed (periodical streak-like or stripe-like weft bar is faintly observed).

Second grade: Weft bar is observed at a glance (periodical streak-like or stripe-like weft bar is observed at a first glance).

First grade: Distinctive weft bar is observed (periodical streak-like or stripe-like weft bar is significant).

The knitted fabric having grade of fourth or fifth was regarded as having no problem about weft bar.

(12) Steam Setting Properties

Two dyed composite crimped yarns are doubled, and fed to a flat knitting machine of 14 gauge to give a flat knitted fabric having a plain knitting structure. The knitted fabric is subjected to steaming for 15 sec, and vacuum treated for 15 sec by a Hoffmann pressing machine (trade name of Kobe Press, manufactured by Kobe Denki Kogyo K.K.).

The knitted fabric thus obtained is cut to give a knitted sample having a size of 40×40 cm. A notch 10 cm long in the longitudinal direction and a notch 10 cm long in the transverse direction are formed near the central portion of the sample. The sample is then allowed to stand for 1 hour, and the spread width (mm) in the central portion of each of the notches is measured. The average value of the measured width of the notch in the warp direction and that in the weft direction is calculated. On the basis of the average value thus obtained, the fabric is rated in accordance with the following criteria:

◎: 0 mm

○: less than 3 mm

Δ: at least 3 mm and less than 10 mm

×: at least 10 mm

(13) Glossiness

A sensory test with a visual sense is conducted by each of 10 inspectors doing research on fibers, and the test results are rated in accordance with the following 5 grades. The results are expressed by a numerical value obtained by averaging the test results of the 10 inspectors.

Fifth grade: The sample has the silk-like glossiness of cellulose filaments.

Fourth grade: The sample has a fairly silk-like glossiness of cellulose filaments.

Third grade: It is hardly discernible whether the sample has a silk-like glossiness of cellulose filaments or a glittering glossiness specific to synthetic fiber filaments.

Second grade: The sample has a fairly glittering glossiness specific to synthetic fiber filaments.

First grade: The sample has a glittering glossiness specific to synthetic fiber filaments.

(14) Hand Touchness

A sensory test with a tactile sense is conducted by each of 10 inspectors doing research on fibers, and the test results are rated in accordance with the following 5 grades. The results are expressed by a numerical value obtained by averaging the test results of the 10 inspectors.

Fifth grade: The sample has a hand touchness specific to cellulose filaments (dry, cool and drapable).

Fourth grade: The sample has a hand touchness fairly specific to cellulose filaments (dry, cool and drapable).

Third grade: It is hardly discernible whether the sample has a hand touchness specific to cellulose filaments or a hand touchness specific to synthetic fiber filaments.

Second grade: The sample has a fairly waxy hand touchness specific to synthetic fiber filaments, and a bulky and elastic hand touchness.

First grade: The sample has a waxy hand touchness specific to synthetic fiber filaments, and a bulky and elastic hand touchness.

EXAMPLE 1

A cuprammonium rayon multifilament yarn (trade name of Bemberg, manufactured by Asahi Chemical Industry Co., Ltd.) of 75 denier/54 filaments as cellulose filaments and a normal pressure-cation dyeable polyester multifilament yarn (brand of CVT (triangular cross section), melting starting temperature of 227° C., manufactured by Asahi Chemical Industry Co., Ltd.) of 50 denier/36 filaments as synthetic fiber filaments were fed to a belt nip type of frictional false-twisting machine (trade name of No. 33 H. Machclimper, manufactured by Murata Machinery Ltd.). Both filament yarns were air interlaced without a feed difference at an overfeed rate of 0.991% under air pressure of 1 kgf/cm$^2$, and false-twisted under the following conditions to give a composite crimped yarn.

| |
|---|
| Twisting speed: 300 m/min |
| Twister belt crossed axes angle: 90° |
| Twisting temperature (H1): 150° C. |
| Heat setting temperature (H2) after untwisting: 180° C. |
| Draw ratio: 1.015 |
| Twister speed/yarn speed: 1.304 |
| Feed rate in the setting step: 5% |
| Feed rate of winding: 5.67% |

Using the composite crimped yarn thus obtained, a circular knitted interlock fabric with 42 yarn feeders and 28 GG was prepared at a density of 42 courses/inch and 40 wells/inch. The knitted fabric was scoured and relaxed at temperatures of 80 to 90° C. with a jet dyeing machine, and preset at 180° C. while the width and length were being maintained. Of the knitted fabrics, subsequent to presetting, half of them were subjected to alkaline sanding. The treated knitted fabrics and the remaining half of knitted fabrics were dyed under the dyeing conditions mentioned below. As a result, powder touch finished (fibrillated by alkaline sanding) knitted fabrics and clear finished knitted fabrics were obtained. In addition, the alkaline sanding was conducted at 80° C. in an aqueous alkaline solution of 4 Baume degree using a jet dyeing machine.

Furthermore, the knitted fabrics were sequentially dyed with a disperse dye, reduction cleaned, heated in a water bath, dyed with a reactive dyestuff, soaped, dried, and treated with a softener under conditions mentioned below to give resultant fabrics.

| | |
|---|---|
| Conditions of Dyeing with Disperse Dyestuff | |
| Disperse dyestuff: Resolin Blue FBL (manufactured by Bayer) | 0.4% owf |
| Tamol type of dispersant (trade name of Disper TL, Meisei Kagaku K.K.) | 1 ml/l |
| pH | 6.5 |
| Bath ratio | 1:20 |
| Dyeing temperature | 110° C. |
| Time | 60 min |
| Conditions of Reduction Cleaning | |
| Hydrosulfite | 2 g/l |
| Sodium hydroxide | 0.5 g/l |
| Bath ratio | 1:20 |
| Treating temperature | 80° C. |
| Treating time | 10 min |
| Conditions of Washing in Water Bath | |
| Bath ratio | 1:20 |
| Treating temperature | 80° C. |
| Treating time | 10 min |
| Conditions of Dyeing with Reactive Dyestuff | |
| Reactive Dyestuff: Sumifix Brill Blue R (manufactured by Sumika Dyestuffs Technology Co., Ltd.) | 0.6% owf |
| Sodium sulfate | 50 g/l |
| Sodium carbonate | 15 g/l |
| Bath ratio | 1:20 |
| Dyeing temperature | 60° C. |
| Dyeing time | 60 min |
| Conditions of Soaping | |
| Detergent (trade name of Scourol FC 250, manufactured by Kao Corporation) | 1 ml/l |
| Bath ratio | 1:20 |
| Treating temperature | 80° C. |
| Treating time | 10 min |
| Conditions of Drying | |
| Fabrics were dried with a pin tenter at 120° C. for 2 minutes. | |
| Conditions of Treatment with a Softener | |
| Fabrics were immersed in an aqueous solution containing 2% by weight of an aminosilicone-based softener (trade name of Nicca Silicone AMZ, manufactured by Nicca Chemical Co., Ltd.), squeezed to have a pick-up of 85%, and dried with a pin tenter at 140° C. for 2 minutes. | |

The composite crimped yarn thus obtained had a crimping elongation of 0.3%. A circular knitted interlock fabric in which the yarn was used had no weft bar, a high quality, glossiness and a hand touchness of cellulose filaments, and softness with drapability. Moreover, the yarn showed a washing shrinkage of 5% or less in the warp and weft directions, and excellent shrinkage proofing properties.

An interlock fabric of a powder touch finish thus came to have the same fine fibrillated surface as that of a similar knitted fabric formed from cuprammonium rayon alone. Moreover, the interlock fabric became a knitted fabric having no weft bar and a high quality, whereas a similar fabric formed from cuprammonium rayon alone cannot have such properties. Furthermore, the interlock fabric was excellent in shrinkage proofing properties and had a feeling of cellulose filaments.

Table 1 shows the physical properties of the composite crimped yarn thus obtained, and the evaluation results of the physical properties, appearance, hand touchness and the like, of the knitted fabric of a clear finish explained above.

EXAMPLE 2

The procedure of Example 1 was repeated under the same conditions as in Example 1 except that the false-twisting temperature (H1) and the heat setting temperature (H2) subsequent to untwisting were set at 180° C. and 150° C., respectively. As a result, a composite crimped yarn showing a crimping elongation of 3.0% was obtained. The composite crimped yarn thus obtained was then treated by the same procedure as in Example 1 to give a circular knitted interlock fabrics with clear and powder touch finishes.

Table 1 shows the physical properties of the composite crimped yarn thus obtained, and the physical properties and the evaluation results of the appearance, hand touchness, etc., of the knitted fabric of a clear finish.

EXAMPLE 3

The procedure of Example 1 was repeated under the same conditions as in Example 1 except that a rayon multifilament yarn of 75 denier/33 filaments was used in place of the cellulose filaments. As a result, a composite crimped yarn showing a crimping elongation of 0.8% was obtained. The composite crimped yarn thus obtained was treated by the same procedure as in Example 1 to give a tubular knitted interlock fabrics with clear and powder touch finishes.

Table 1 shows the physical properties of the composite crimped yarn thus obtained, and the physical properties and the evaluation results of the appearance, hand touchness, etc., of the knitted fabric of a clear finish.

EXAMPLE 4

The procedure of Example 1 was repeated under the same conditions as in Example 1 except that a polyethylene terephthalate multifilament yarn of 50 denier/36 filaments was used in place of the synthetic fiber filaments. As a result, a composite crimped yarn showing a crimping elongation of 0.5% was obtained. The composite crimped yarn thus obtained was treated by the same procedure as in Example 1 to give a circular knitted interlock fabrics with clear and powder touch finishes.

Table 1 shows the physical properties of the composite crimped yarn thus obtained, and the physical properties and the evaluation results of the appearance, hand touchness, etc., of the knitted fabric of a clear finish.

EXAMPLE 5

The procedure of Example 1 was repeated under the same conditions as in Example 1 except that a cuprammonium rayon multifilament yarn of 120 denier/90 filaments was used in place of the cellulose filaments. As a result, a composite crimped yarn showing a crimping elongation of 1.0% was obtained. The composite crimped yarn thus obtained was treated by the same procedure as in Example 1 except that a circular knitted interlock fabric of 22 GG was formed to give a circular knitted interlock fabrics with clear and powder touch finishes.

Table 1 shows the physical properties of the composite crimped yarn thus obtained, and the physical properties and the evaluation results of the appearance, hand touchness, etc., of the knitted fabric of a clear finish.

EXAMPLE 6

The procedure of Example 5 was repeated under the same conditions as in Example 5 except that the polyester multifilament yarn in Example 5 was replaced with a polyester multifilament yarn of 30 denier/24 filaments (circular cross section, brand of CQT, manufactured by Asahi Chemical Industry Co., Ltd.). As a result, a composite crimped yarn showing a crimping elongation of 0.8% was obtained. A circular knitted interlock fabric was prepared from the composite crimped yarn using a circular knitting machine of 22 GG. The knitted fabric thus obtained was treated by the same procedure as in Example 1 to give a knitted fabrics with clear and powder touch finishes.

Table 1 shows the physical properties of the composite crimped yarn thus obtained, and the physical properties and the evaluation results of the appearance, hand touchness, etc., of the knitted fabric of a clear finish.

EXAMPLE 7

The composite cramped yarn obtained in Example 5 was cheese dyed, and knitted into a flat knitted fabric having a plain knitting structure.

The yarn was cheese dyed by a procedure as explained below. The yarn was wound with a soft winding winder to give 1 kg of a wound cheese having a winding density of 0.40 g/cm$^3$. The cheese was dyed with a dispersion cationic dyestuff and a reactive dyestuff using a cheese-dyeing machine (small cheese dyeing machine, manufactured by Nichihan Seisakusho K.K.).

The cheese dyed composite crimped yarn was doubled, and knitted by a flat knitting machine (14 gauge, manufactured by Kopp K.K.) to give a flat knitted fabric. The knitted fabric was then subjected to steaming for 15 sec, and vacuum treated for 15 sec by a Hoffmann pressing machine (trade name of Kobe Press, manufactured by Kobe Denki Kogyo K.K.). Table 2 shows the evaluation results of the flat knitted fabric thus obtained.

EXAMPLE 8

The procedure of Example 5 was repeated under the same conditions as in Example 5 except that a rayon multifilament yarn of 120 denier/8 filaments (trade name of Illumi Yarn, manufactured by Asahi Chemical Industry Co., Ltd.) was used in place of the cellulose filaments. As a result, a composite crimped yarn showing a crimping elongation of 1.5% was obtained.

The composite crimped yarn thus obtained was cheese dyed and knitted in the same manner as in Example 7 to give a flat knitted fabric having a plain knitting structure.

Table 2 shows the physical properties of the composite crimped yarn thus obtained, and the physical properties and the evaluation results of the appearance, hand touchness, etc., of the flat knitted fabric.

EXAMPLE 9

The procedure of Example 1 was repeated under the same conditions as in Example 1 except that a nylon 66 multifilament yarn of 50 denier/48 filaments (trade name of Leona, manufactured by Asahi Chemical Industry Co., Ltd.) as synthetic fiber filaments and a cuprammonium rayon multifilament yarn of 75 denier/54 filaments (trade name of Bemberg, manufactured by Asahi Chemical Industry Co., Ltd.) as cellulose filaments were used. As a result, a composite crimped yarn showing a crimping elongation of 0.4% was obtained. The composite crimped yarn thus obtained was then treated by the same procedure as in Example 1 to give a knitted interlock fabrics with clear and powder touch finishes.

Furthermore, the knitted fabric was sequentially dyed with an acid dyestuff using a jet dyeing machine, heated in a water bath, dyed with a reactive dyestuff, soaped, dried, and treated with a softener under the conditions mentioned below to give a resultant fabric.

| | |
|---|---|
| Conditions of Dyeing with Acid Dyestuff | |
| Acid Dyestuff: Telon Blue A3GL (manufactured by Dye Star) | 0.4% owf |
| pH | 4.0 |
| Bath ratio | 1:20 |
| Dyeing temperature | 100° C. |
| Dyeing time | 60 min |
| Conditions of Washing in Water Bath | |
| Bath ratio | 1:20 |
| Treating temperature | 80° C. |
| Treating time | 10 min |
| Conditions of Dyeing with Reactive Dyestuff | |
| Reactive Dyestuff: Sumifix Brill Blue R (manufactured by Sumika Dyestuffs Technology Co., Ltd.) | 0.6% owf |
| Sodium sulfate | 50 g/l |
| Sodium carbonate | 15 g/l |
| Bath ratio | 1:20 |
| Dyeing temperature | 60° C. |
| Dyeing time | 60 min |
| Conditions of Soaping | |
| Scourol FC 250 (detergent, manufactured by Kao Corporation) | |
| Bath ratio | 1:20 |
| Treating temperature | 80° C. |
| Treating time | 10 min |
| Conditions of Drying | |
| The fabric was dried at 120° C. for 2 minutes with a pin tenter. | |
| Conditions of Treatment with a Softener | |
| The fabric was immersed in an aqueous solution containing 2% by weight of an aminosilicone-based softener (trade name of Nicca Silicone AMZ, manufactured by Nicca Chemical Co., Ltd.), squeezed to have a pick-up of 85%, and dried at 140° C. for 2 minutes. | |

Table 2 shows the physical properties of the composite crimped yarn thus obtained, and the physical properties and the evaluation results of an appearance, a hand touchness, etc., of the knitted fabric of a clear finish.

EXAMPLE 10

The procedure of Example 1 was repeated under the same conditions as in Example 1 except that a cuprammonium rayon multifilament yarn of 100 denier/75 filaments was used in place of the cellulose filaments. As a result, a composite crimped yarn showing a crimping elongation of 0.35% was obtained.

A circular knitted interlock fabric was prepared from the composite crimped yarn thus obtained using a circular knitting machine of 22 GG. The fabric was treated by the same procedure as in Example 1 to give a circular knitted interlock fabrics with clear and powder touch finishes.

Table 2 shows the physical properties of the composite crimped yarn thus obtained, and the physical properties and the evaluation results of the appearance, hand touchness, etc., of the knitted fabric of a clear finish.

EXAMPLE 11

The procedure of Example 1 was repeated under the same conditions as in Example 1 except that the heat setting temperature (H2) subsequent to untwisting was set at 220° C. As a result, a composite crimped yarn showing a crimping elongation of 0.20% was obtained.

The composite crimped yarn thus obtained was treated by the same procedure as in Example 1 to give a circular knitted interlock fabrics with clear and powder touch finishes.

Table 2 shows the physical properties of the composite crimped yarn thus obtained, and the physical properties and the evaluation results of the appearance, hand touchness, etc., of the knitted fabric of a clear finish.

EXAMPLE 12

The procedure of Example 1 was repeated under the same conditions as in Example 1 except that a polyethylene terephthalate multifilament yarn (trade name of Technofine, brand of SWS, manufactured by Asahi Chemical Industry Co., Ltd.) of 50 denier/30 filaments having a w-shaped cross section was used in place of the synthetic fiber filaments. As a result, a composite crimped yarn showing a crimping elongation of 0.35% was obtained.

A circular knitted interlock fabric was prepared from the composite crimped yarn thus obtained, using a circular knitting machine of 22 GG. The fabric was treated by the same procedure as in Example 1 to give a circular knitted interlock fabrics with clear and powder touch finishes.

Table 2 shows the physical properties of the composite crimped yarn thus obtained, and the physical properties and the evaluation results of the appearance, hand touchness, etc., of the knitted fabric of a clear finish.

The circular knitted interlock fabrics obtained in Examples 2 to 6 and 9 to 12 each had a high quality to such a degree that each of the fabrics had no weft bar similarly to the circular knitted interlock fabric in Example 1, or the fabric had faintly recognizable weft bar when the observation angle was selected. The fabrics had the glossiness and the hand touchness of cellulose filaments, and softness with drapability. Moreover, the fabrics also showed a washing shrinkage of 5% or less in the warp and weft directions. That is, the fabrics were excellent in shrinkage proofing properties.

Furthermore, the flat knitted fabrics obtained in Examples 7 to 8 each had the glossiness and the hand touchness of cellulose filaments, were excellent in shrinkage proofing properties and crease-resistant properties, and showed steam setting properties as good as less than 3 mm.

Comparative Example 1

The procedure of Example 1 was repeated under the same conditions as in Example 1 except that the false-twisting temperature (H1) and the heat setting temperature (H2) subsequent to untwisting were set at 200° C. and 180° C., respectively. As a result, a composite textured yarn showing a crimping elongation of 7.0% was obtained. The composite textured yarn thus obtained was treated by the same procedure as in Example 1 to give a circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

Comparative Example 2

The procedure of Example 1 was repeated under the same conditions as in Example 1 except that the false-twisting temperature (H1) and the heat setting temperature (H2) subsequent to untwisting were set at 180° C. and room temperature, respectively. As a result, a composite textured yarn showing a crimping elongation of 8.4% was obtained. The composite textured yarn thus obtained was treated by the same procedure as in Example 1 to give a circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

Comparative Example 3

The procedure of Example 1 was repeated under the same conditions as in Example 1 except that the false-twisting temperature (H1) and the heat setting temperature (H2) subsequent to untwisting were set at 80° C. and 180° C., respectively. As a result, a composite textured yarn showing a crimping elongation of 0.05% was obtained. The composite textured yarn thus obtained was treated by the same procedure as in Example 1 to give a circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

Comparative Example 4

The procedure of Example 1 was repeated under the same conditions as in Example 1 except that cuprammonium rayon of 120 denier/90 filaments prepared from cellulose filaments alone was used and that no synthetic fiber filaments were used. As a result, a treated yarn formed from cellulose filaments alone and showing a crimping elongation of 0.2% was obtained. The treated yarn thus obtained was treated by the same procedure as in Example 1 to give a circular knitted fabrics with clear and powder touch finishes.

Table 3 shows the physical properties of the treated yarn thus obtained, and the physical properties and the evaluation results of an appearance, a hand touchness, etc., of the knitted fabric of a clear finish.

Comparative Example 5

The procedure of Example 1 was repeated under the same conditions as in Example 1 except that a cuprammonium rayon multifilament yarn of 50 denier/30 filaments as cellulose filaments and a polyethylene terephthalate multifilament yarn of 75 denier/36 filaments as synthetic fiber filaments were used. As a result, a composite textured yarn showing a crimping elongation of 0.5% was obtained. The composite textured yarn thus obtained was then treated by the same procedure as in Example 1 to give circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

Comparative Example 6

The procedure of Example 1 was repeated under the same conditions as in Example 1 except that the yarn was not treated by the false-twisting step subsequent to interlacing combination. As a result, a composite textured yarn showing a crimping elongation of 0.01% was obtained. The composite textured yarn thus obtained was then treated by the same procedure as in Example 1 to give a circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

Comparative Example 7

The procedure of Comparative Example 3 was repeated under the same conditions as in Comparative Example 3 except that the yarn was not subjected to heat setting subsequent to untwisting. As a result, a composite textured yarn showing a crimping elongation of 0.06% was obtained. The composite textured yarn thus obtained was then treated by the same procedure as in Example 1 to give a circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

Comparative Example 8

The procedure of Example 1 was repeated under the same conditions as in Example 1 except that the heat setting temperature (H2) subsequent to untwisting was set at 240° C. As a result, a composite textured yarn showing a crimping elongation of 0.03% was obtained. The composite textured yarn thus obtained was then treated by the same procedure as in Example 1 to give a circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

Comparative Example 9

The procedure of Example 1 was repeated under the same conditions as in Example 1 except that a cuprammonium rayon multifilament yarn alone of 75 denier/54 filaments was used as cellulose filaments and that no synthetic fiber filaments were used. As a result, a false-twisted yarn formed from cellulose multifilaments alone showing a crimping elongation of 0.2% was obtained. Next, a polyester multifilament yarn (brand of CVT (triangular cross section), melting starting temperature of 227° C., manufactured by Asahi Chemical Industry Co., Ltd.) of normal pressure cation dyeable type having a size of 50 denier/36 filaments and the false-twisted yarn obtained above were doubled, and twisted under the condition of 600 T/m by a commercially available twisting machine to give a composite textured yarn of twisted yarn type.

The composite textured yarn thus obtained was then treated by the same procedure as in Example 1 except that the composite textured yarn was used to give a circular knitted fabrics with clear and powder touch finishes.

Table 3 shows the physical properties of the composite textured yarn thus obtained, and the physical properties and the evaluation results of the appearance, hand touchness, etc., of the knitted fabric of a clear finish.

It is seen from Table 3 that the circular knitted interlock fabrics in Comparative Examples 1 and 2 had a waxy hand touchness specific to polyester filaments and a glittering glossiness because the crimping elongation was large. The circular knitted fabrics were therefore significantly different from similar knitted fabrics formed from cellulose filaments alone. Moreover, for the circular knitted fabrics of a powder touch finish, the cuprammonium rayon could not be sufficiently fibrillated.

Weft bar was formed in the circular knitted interlock fabric in Comparative Example 3 and that in Comparative Example 4, and both knitted fabrics did not have a high quality because the yarn of the former fabric showed an excessively small crimping elongation and the yarn of the latter fabric did not contain combined polyester filaments.

The circular knitted interlock fabric in Comparative Example 5 did not have weft bar, and showed excellent shrinkage proofing properties. However, since the proportion of the polyester filaments in the yarn was high, the knitted fabric lacked glossiness and the hand touchness of cellulose filaments.

The circular knitted interlock fabric in Comparative Example 6 was prepared by interlace combination alone without a false-knitting step. As a result, the knitted fabric had nonuniform combination. The knitted fabric surface was therefore dotted with polyester filaments showing a glittering glossiness, and the knitted fabric of a powder touch finish had an appearance wherein fibrillation is nonuniform, and unevenness is considerable. Furthermore, the yarn showed a crimping elongation close to zero, and weft bar significantly appeared on the knitted fabric to lower the quality.

Since the composite textured yarn in Comparative Example 7 was not heat set subsequently to untwisting, the yarn showed a crimping elongation of 0.06%. Accordingly, the circular knitted interlock fabric prepared therefrom had weft bar that could be recognized at a glance, and the appearance quality became poor. Furthermore, the polyester filaments showed a significant shrinkage up to the step of dyeing finish, and the knitted fabric had a hard hand touchness.

Since the heat setting subsequent to untwisting of the composite textured yarn was conducted at 240° C. close to the melting starting temperature of the polyester filaments, in Comparative Example 8, the composite textured yarn showed a crimping elongation as small as 0.03. As a result, the circular knitted fabric formed from the composite textured yarn had weft bar rated as poor as second grade. Moreover, the polyester filaments projected out the sheath portions, and the knitted fabric had a lowered glossiness and an impaired hand touchness of cellulose filaments.

Since the composite textured yarn in Comparative Example 9 was not twisted, the knitted fabric could not have the glossiness and the hand touchness of cellulose filaments. Since the polyester filaments and the cellulose filaments were not doubled, the knitted fabric had a waxy hand touchness specific to a polyester fiber. Moreover, since polyester filaments were exposed to the surface in the knitted fabric of a powder touch finish, the treatment became nonuniform and insufficient, and the appearance quality was low. Furthermore, although the weft bar formation was somewhat decreased, the decrease was insufficient because the polyester was not crimped.

TABLE 1

Physical Properties of Composite Textured Yarns and Evaluation Results of Knitted Fabrics (Examples)

| | Examples | | | | | |
|---|---|---|---|---|---|---|
| | 1 | 2 | 3 | 4 | 5 | 6 |
| Weight proportion of Cellulose filaments (%) | 60 | 60 | 60 | 60 | 70.5 | 80 |
| False-twisting temperature H1 (° C.) | 150 | 180 | 150 | 150 | 150 | 150 |
| Heat setting temperature H2 (° C.) | 180 | 150 | 180 | 180 | 180 | 180 |
| <Physical properties of textured yarn> | | | | | | |
| Crimping elongation (%) | 0.30 | 3.0 | 0.80 | 0.50 | 1.0 | 0.80 |
| Crimping elongation after boil-off treatment (%) | 1.4 | 3.8 | 2.3 | 2.4 | 2.8 | 2.0 |
| Dry heat shrinkage (%) (after boil-off treatment) | 4.0 | 4.0 | 3.9 | 4.9 | 3.5 | 2.8 |
| <Type of knitted fabric> | C.K.I.F.* | C.K.I.F.* | C.K.I.F.* | C.K.I.F.* | C.K.I.F.* | C.K.I.F.* |
| Thickness (mm) | 0.48 | 0.50 | 0.49 | 0.49 | 0.67 | 0.58 |
| Weight (g/m$^2$) | 205 | 210 | 205 | 205 | 290 | 250 |
| Compression property (LC) | 0.484 | 0.545 | 0.490 | 0.490 | 0.455 | 0.430 |
| Washing shrinkage (%) warp | 1.5 | 1.4 | 2.0 | 1.5 | 2.0 | 3.0 |
| (G method) weft | 3.0 | 3.5 | 3.0 | 2.8 | 4.0 | 4.5 |
| W & W properties (grade) | 5 | 5 | 5 | 5 | 4.5 | 4 |
| Surface occupation rate of cellulose (%) | 90 | 80 | 88 | 88 | 93 | 95 |
| Weft bar (grade) | 5 | 5 | 5 | 5 | 4.5 | 4 |
| Glossiness (grade) | 5 | 5 | 5 | 5 | 5 | 5 |
| Hand touchness (grade) | 5 | 5 | 5 | 5 | 5 | 5 |

Note:
*C.K.I.F. = circular knitted interlock fabric

TABLE 2

Physical Properties of Composite Textured Yarns and Evaluation Results of Knitted Fabrics (Examples)

| | Examples | | | | | |
|---|---|---|---|---|---|---|
| | 7 | 8 | 9 | 10 | 11 | 12 |
| Weight proportion of Cellulose filaments (%) | 70.5 | 70.5 | 60 | 67 | 60 | 60 |
| False-twisting temperature H1 (° C.) | 150 | 150 | 150 | 150 | 150 | 150 |
| Heat setting temperature H2 (° C.) | 180 | 180 | 180 | 180 | 220 | 180 |
| <Physical properties of textured yarn> | | | | | | |
| Crimping elongation (%) | 1.0 | 1.5 | 0.40 | 0.35 | 0.20 | 0.35 |
| Crimping elongation after boil-off treatment (%) | 2.8 | 3.0 | 1.6 | 1.6 | 1.2 | 1.5 |
| Dry heat shrinkage (%) (after boil-off treatment) | 3.5 | 3.5 | 3.5 | 3.7 | 2.0 | 4.5 |
| <Type of knitted fabric> | F.K.F.+ | F.K.F.+ | C.K.I.F.* | C.K.I.F.* | C.K.I.F.* | C.K.I.F.* |
| Thickness (mm) | 0.69 | 0.70 | 0.49 | 0.55 | 0.40 | 0.45 |
| Weight (g/m$^2$) | 290 | 295 | 205 | 220 | 200 | 203 |
| Compression property (LC) | 0.455 | 0.470 | 0.490 | 0.380 | 0.320 | 0.440 |
| Washing shrinkage (%) warp | 3.0 | 3.5 | 2.0 | 2.0 | 1.3 | 1.4 |
| (G method) weft | 3.5 | 4.0 | 3.5 | 3.5 | 2.5 | 2.5 |
| W & W properties (grade) | 4.5 | 4.5 | 5 | 5 | 5 | 5 |
| Surface occupation rate of cellulose (%) | 92 | 85 | 90 | 93 | 82 | 91 |
| Weft bar (grade) | — | — | 5 | 5 | 4 | 5 |
| Glossiness (grade) | 5 | 5 | 5 | 5 | 4 | 5 |
| Hand touchness (grade) | 5 | 5 | 5 | 5 | 4 | 5 |

Note:
+F.K.F = flat knitted fabric
*C.K.I.F. = circular knitted interlock fabric

TABLE 3

Physical Properties of Composite Textured Yarns and Evaluation Results of Knitted Fabrics (Comparative Examples)

| | Comparative Examples | | | | | | | | |
|---|---|---|---|---|---|---|---|---|---|
| | 1 | 2 | 3 | 4 | 5 | 6 | 7 | 8 | 9 |
| Weight proportion of Cellulose filaments (%) | 60 | 60 | 60 | 100 | 40 | 60 | 60 | 60 | 60 |
| False-twisting temperature H1 (° C.) | 200 | 180 | 80 | 150 | 150 | — | 80 | 150 | 150** |
| Heat setting temperature H2 (° C.) | 180 | — | 180 | 180 | 180 | — | — | 240 | 180** |
| <Physical properties of textured yarn> | | | | | | | | | |
| Crimping elongation (%) | 7.0 | 8.4 | 0.05 | 0.20 | 0.50 | 0.01 | 0.06 | 0.03 | 0.05 |

TABLE 3-continued

Physical Properties of Composite Textured Yarns and Evaluation Results of Knitted Fabrics (Comparative Examples)

| | Comparative Examples | | | | | | | | |
|---|---|---|---|---|---|---|---|---|---|
| | 1 | 2 | 3 | 4 | 5 | 6 | 7 | 8 | 9 |
| Crimping elongation after boil-off treatment (%) | 8.1 | 5.6 | 0.10 | 0.01 | 8.5 | 0.02 | 5.5 | 0.07 | 0.07 |
| Dry heat shrinkage (%) (after boil-off treatment) | 2.0 | 4.2 | 2.0 | 0.03 | 5.0 | 3.2 | 5.0 | 0.5 | 2.5 |
| <Type of knitted fabric> | C.K.I.F.* | C.K.I.F.* | C.K.I.F.* | C.K.I.F.* | C.K.I.F.* | C.K.I.F.* | C.K.I.F.* | C.K.I.F.* | C.K.I.F.* |
| Thickness (mm) | 0.59 | 0.58 | 0.48 | 0.45 | 0.62 | 0.55 | 0.56 | 0.58 | 0.65 |
| Compression property (LC) | 0.605 | 0.610 | 0.455 | 0.250 | 0.615 | 0.460 | 0.500 | 0.620 | |
| Weight (g/m$^2$) | 220 | 220 | 205 | 210 | 190 | 205 | 215 | 220 | 235 |
| Washing shrinkage (%) warp | 2.0 | 2.0 | 1.5 | 8.0 | 1.5 | 1.5 | 2.0 | 1.5 | 3.5 |
| (G method) weft | 3.5 | 3.3 | 3.0 | 10 | 2.0 | 3.0 | 3.3 | 2.0 | 4.0 |
| W & W properties (grade) | 5 | 5 | 4.5 | 3 | 5 | 4 | 4.5 | 5 | 4.5 |
| Surface occupation rate of cellulose (%) | 55 | 45 | 60 | 100 | 45 | 50 | 50 | 40 | 60 |
| Weft bar (grade) | 5 | 5 | 2.5 | 2 | 5 | 2.5 | 2 | 2 | 3 |
| Glossiness (grade) | 2 | 1 | 5 | 5 | 2 | 2 | 2 | 2 | 3 |
| Hand touchness (grade) | 2 | 1 | 5 | 5 | 1 | 3 | 2 | 2 | 3 |

Note:
*C.K.I.F. = circular knitted interlock fabric
**Cellulose alone was textured.

INDUSTRIAL APPLICABILITY

A weft knitted fabric prepared from the composite crimped yarn of the present invention has no weft bar, an appearance of high quality, and the glossiness and the hand touchness of cellulose filaments, and is excellent in shrinkage proofing properties and setting properties.

Accordingly, the composite crimped yarn of the present invention can be applied to apparel for innerwear, sportswear and outerwear that are required to have high wet strength and dimensional stability, and an excellent quality of a knitted fabric.

What is claimed is:

1. A composite crimped yarn comprising from 50 to 90% by weight of cellulose filaments and synthetic fiber filaments, both of said filaments having fine crimps and being approximately uniformly combined, and said composite crimped yarn having a crimping elongation of 0.1 to 4.0%.

2. The composite crimped yarn of claim 1, wherein the synthetic fiber filaments are polyester filaments.

3. The composite crimped yarn of claim 1, wherein the yarn subsequent to a boil-off treatment shows a dry heat shrinkage of 1.0 to 5.0%.

4. The composite crimped yarn of claim 1 or 2, wherein the synthetic fiber filaments are of a copolymerized polyester fiber having a melting starting temperature of 200 to 240° C.

5. A weft knitted fabric, which is formed from the composite crimped yarn of claim 1, the cellulose filaments of which show a surface occupation rate of at least 70% on a surface of the knitted fabric.

6. The weft knitted fabric of claim 5, wherein the fabric has a KES compression property (LC) of 0.30 to 0.55.

* * * * *